United States Patent [19]

Fiore et al.

[11] 4,002,178

[45] Jan. 11, 1977

[54] FOAMS AND SPONGE SHEET FOR CIGAR MANUFACTURE

[75] Inventors: Joseph V. Fiore; T. Kenneth Kelly, both of Fairfield, Conn.; William J. Nellen, Richmond, Va.

[73] Assignee: AMF Incorporated, White Plains, N.Y.

[22] Filed: Oct. 29, 1974

[21] Appl. No.: 518,446

Related U.S. Application Data

[62] Division of Ser. No. 428,959, Dec. 27, 1973, Pat. No. 3,872,871.

[52] U.S. Cl. ..... 131/15 R; 131/17 R

[51] Int. Cl.[2] ..... A24D 1/02; A24B 3/14

[58] Field of Search ..... 131/15, 17, 2, 140, 131/140 P, 140 C, 140 R

[56] References Cited

UNITED STATES PATENTS

| | | | |
|---|---|---|---|
| 2,656,841 | 10/1953 | Gurley et al. | 131/140 P |
| 3,364,935 | 1/1968 | Moshy et al. | 131/140 C |
| 3,528,434 | 9/1970 | Halter et al. | 131/140 P |
| 3,613,693 | 10/1971 | Monte | 131/140 C |
| 3,746,012 | 7/1973 | Deszyck | 131/140 P |

*Primary Examiner*—Robert W. Michell
*Assistant Examiner*—V. Millin
*Attorney, Agent, or Firm*—George W. Price; Charles J. Worth

[57] ABSTRACT

Cigar tobacco sheet of low density, smoking articles prepared therewith, and foamed intermediates therefor. Fine-bubble stable foams, wherein at least 80% of the bubbles are less than about 100 microns in normalized dimension are formed in a high shear system utilizing tobacco particles of generally smaller than 100–120 mesh. The foam is cast and dried to form reconstituted cigar tobacco sheet, utilized preferably for wrapper and/or binder in cigars, characterized especially by excellent taste.

10 Claims, No Drawings

FOAMS AND SPONGE SHEET FOR CIGAR MANUFACTURE

This is a divisional of application Ser. No. 428,959 filed Dec. 27, 1973 now U.S. Pat. No. 3,872,871.

Processes for manufacture of reconstituted tobacco products were developed initially for economic reasons, in response to industry needs to more fully utilize the entire tobacco leaf in the manufacture of smoking articles, and have been of commercial significance for the past twenty years. The earliest processes involved conversion of cigarette tobacco leaf dust fines (produced during the threshing and shredding) and stems into reconstituted cigarette sheet, which could be shredded and blended back with natural tobacco shreds for the manufacture of cigarettes. Accordingly, for the cost of conversion of these waste materials into usable sheets, approximately 15 cents – 30 cents/lb., reconstituted sheets were produced with an effective value equal to the natural tobacco of $1.00/lb. or more. The commercial usage of these processes was subsequently extended to cigars. For cigar applications, the impetus for usage of reconstituted tobacco sheet was a combination of material savings versus the cost of the natural tobacco leaves which were replaced, and labor savings, since rolls of reconstituted sheet could be dispensed into cigar machinery automatically, thus replacing cigar machine operators that previously fed in natural tobacco leaf by hand. Initially, reconstituted cigar binder (the leaf under the wrapper on a cigar) was developed, and eventually replaced natural binder on about 90% of the cigars manufactured in the U.S.A. The taste properties of cigars utilizing reconstituted binder were not equivalent to those of the same cigars with natural binder, but the savings in material and labor costs at a time of otherwise spiralling manufacturing costs dictated the necessity of such a change. Cigar sales in the U.S.A. since that time have trended downward, a situation which some relate to the usage of reconstituted binder and the changed taste characteristics of American Cigars with reconstituted binder.

Reconstituted cigar wrapper sheets were subsequently developed and introduced commercially on cigars replacing natural wrapper. The economic incentives for usage of reconstituted cigar wrapper were decidedly greater than for reconstituted cigar binder, since the natural Connecticut or Florida shade wrappers being replaced were valued at about $7.00 to $20.00 per pound, whereas natural cigar binders only cost about $2.00 per pound. In addition, an increasing scarcity of labor willing to hand-lay natural wrappers was an additional factor pushing the manufacturer towards usage of reconstituted cigar wrapper, which could be automatically dispensed. In spite of this, all market efforts involving use of reconstituted cigar wrapper in place of natural wrapper on cigars have been generally unsuccessful, and have reflected the inability of reconstituted cigar wrappers made in accordance with the prior art to match the taste characteristics of natural shade-grown wrappers on cigars. As a result, commercial usage of reconstituted cigar wrapper has been mostly limited to low-priced tipped cigarillo cigars, which represents only about 30% of the total cigar markets in the U.S.A. Such cigars traditionally used the lowest quality natural leaf wrappers, and had taste properties at the low end of the cigar taste spectrum. On untipped larger cigars, however, even potential savings to the manufacturer of greater than $10.00 per thousand cigars have not led to significant commercial usage, since all market efforts with these products have resulted in substantial deterioration of sales due to unacceptable modification of the taste characteristic.

It is interesting to note that cigar wrapper and binder, although only approximately 8% and 12% respectively of the weight of a cigar, contribute decidedly more than their proportionate share to the taste characteristics of the total cigar. The wrapper, outer most on the cigar, is a major contributor, in spite of its low proportion by weight. Binder contributes somewhat less. With cigar filler, decidedly greater changes in composition are possible before detectable changes in taste occur. As a result, conventional reconstituted sheet made in accordance with the prior art is already used and accepted at levels of up to about 20% in cigars. The same situation exists with respect to cigarette tobacco filler. Conventional reconstituted cigarette sheet can be used in cigarette filler blends at levels up to about 10–15% without detection, and at levels up to 20–25% without seriously altering the taste characteristics of the cigarette. Contrast this with cigar wrapper, where a chnage of only 8% of the cigar, but on the outside of the cigar rod, can result not only in detectable changes, but in drastic changes in the taste and aroma characteristics of the smoking article to the extent that the consumer acceptability is radically altered.

The art of producing foamed reconstituted tobacco products is relatively new. Moshy and Germino, in U.S. Pat. No. 3,364,935, U.S. Pat. No. 3,404,690, U.S. Pat. No. 3,404,691 and U.S. Pat. No. 3,410,279 describe processes for combining a foaming agent, a foam stabilizing agent and tobacco, at least one element of said mixture being adhesive. The mixture is processed to create a foamed tobacco slurry, which is subsequently shaped and dried to form a foamed tobacco product, such as a rod or a sheet. In the preferred embodiments of these processes, products with open cellular structures are produced, probably as described below, as a result of the relative instability of the foamed tobacco slurry which results in bubbles breaking and coalescing during the mechanical pumping and shaping operations, and channel formation through the structure during the process of water removal while drying the shaped foamed composition. This particular character of foamed tobacco slurry is obviously quite desirable if the objective is a product with an open cellular structure.

In U.S. Pat. No. 3,613,693, Monte discloses the use of a particular foam-stabilizing agent, a special grade of ethylhydroxyethyl cellulose, which improves the stability of the foamed tobacco slurries of the type described by Moshy and Germino. As a result, improved control over slurry foam density during manufacture is described with resultant improvements in products uniformity, including weight, firmness and draw.

The foamed reconstituted products disclosed by Moshy and Germino, and the foamed reconstituted products with improved stability disclosed by Monte, were generally undetectable in cigarette blends at levels of up to 5%, but were readily detectable and, in addition, commercially unacceptable at levels of 10% or more in a cigarette tobacco blend. Subsequent improvements in such processes and formulations involving reductions in the amount of air incorporation, increased uniformity of bubble size and increases in tobacco content have made usage of such products at levels up to 25% in cigarette tobacco blends possible, but beyond those levels the reconstituted tobacco product is readily detectable and distorts the cigarette taste and aroma to the extent that it is commercially unacceptable. From these data it is apparent that foamed reconstituted tobacco sheet would have a limited capacity for replacing natural tobacco, primarily due to the adverse affect on taste, at levels in excess of 25% of a filler blend. Even with the improvements on foamed tobacco sheet, up to the present time it has not been possible to effect a 100% substitution of foamed tobacco for natural tobacco. Accordingly, it would not be considered feasible that such products could replace natural wrapper in cigars without significant effects on taste and aroma characteristics in view of the very substantial contribution which wrapper makes to the total cigar taste and aroma.

BROAD DESCRIPTION OF THE INVENTION

The present invention provides new and useful cigar tobacco foams, cigar tobacco sheet material made with said foams and cigars produced therefrom. These reconstituted tobacco products for the first time match the taste and burn properties of the natural leaf tobaccos which they are intended to replace.

The new foams of the present invention comprise aircured, fermented tobacco particles of fine-particle size, the foam being characterized by relatively fine bubbles and a density of from about 0.85 to about 1.0 g/cc. The present new foams should have fine bubble size, at least 80% of the bubbles being less than about 100 microns and are substantially stable foams. Such foams are prepared by known procedures utilizing, for example, a foaming agent and foam stabilizer and a suspension of the tobacco particles in water which on agitation results in formation of the foam. To obtain the requisite bubble size, the foam mixture must be subjected to high shear forces such as produced by rotor/stator mixers at high speeds. Conveniently, the foam composition can be prepared and the fine bubble formation effected simultaneously in the rotor/stator mixer. Alternatively, the foam can be formed and then subjected to high shear forces in a subsequent step. Thus, the foamable composition can be prepared by standard methods, e.g. by preparing an aqueous dispersion of tobacco, a foaming agent, foam stabilizer and adhesive. Conveniently, the foaming agent and/or foam stabilizer can be the adhesive required for subsequent formation of tobacco sheet. Usually, the foaming agent is also an adhesive for the present purpose and some foaming agents may also serve as foam stabilizer. Generally polysaccharide gums with thermal gelation properties, such as methyl cellulose or its derivatives are particularly effective foaming agents, since the thermal gelation characteristics provides added stability to the foam during the subsequent processing to sheet material, especially in the foam-drying step. If the tobacco itself is processed in accordance with the procedure described in U.S. Pat. No. 3,464,422 to develop adhesive properties, then the tobacco can serve as the foaming agent, and only a foam stabilizer need be present in the foamable composition.

Useful foam stabilizers are the adhesives with foam stabilizing properties in tobacco foam systems, such as ethylhydroxyethyl cellulose described in the aforesaid Monte patent.

When the present foams are subjected to high shear force to form the requisite fine bubbles of the dispersing gas, i.e. at least 80% of the bubbles are not greater than 100 microns in diameter, the size distribution of the remaining bubbles is not critical. Usually, under the shear force required to attain the aforesaid requisite size, it is found that less than about 8% of the bubbles are greater than about 150 microns in size and within the requisite size, about 30% of the bubbles are of a size less than about 50 microns. Of course, the size distribution of bubbles within the requisite size is not critical as long as 80% of the bubbles are not greater than 100 microns. The size will vary with the initial foamable composition and the ingredients thereof, as well as the shear force applied to the foam, the dispersing gas and other factors as will be recognized by those skilled in the art.

In general, the formation of the present foams as well as the formation of the requisite bubble size is usually conducted at temperatures below about 80° F, to avoid thermal decomposition of the foam. When applying the high shear force to form fine bubble size, frictional forces tend to cause temperature increases which are readily controllable, e.g., by precooling the foamable composition, or cooling the resulting foam, or provision of a cooling jacket for the rotor-stator mixer, or combinations of these, as required. To attain the requisite bubble size, using a rotor-stator mixer, clearances between stator pins and rotor pins are in the range of 0.01 inch to 0.10 inch and the mixer is employed at peripheral speeds in the range of 10 feet to 200 feet per second. The resulting foams are of fine bubble size and decided uniformity as required. The usual procedure employed is to combine a stream of tobacco suspension in water with a second stream of the foaming agent stabilizer and adhesive in water and charge the combined streams into the rotor/stator mixer into which a dispersing gas is introduced. To assist in the subdivision of the gas bubbles to requisite size, auxiliary apparatus can be used to reduce the bubble size of the gas being introduced, e.g. a sparger, which is a tube containing precision-fine pores positioned at the entrance to the mixer head through which the gas is injected into the liquid foamable stream. Thus, the sparger breaks up the inlet gas stream into fine bubbles which are further refined in the mixer. With sparger pore sizes in the range of 0.2 micron to 3.0 microns, finer bubble sizes are produced at constant mixer and slurry flow conditions, or, alternatively, the same bubble sizes are produceable at less rigorous mixer conditions or at faster slurry flow conditions.

The present new foams that are so produced have unusually high order stability, showing little, if any, significant breakdown even after periods of up to one hour at room temperature while exposed to the atmosphere. Generally, the foams are usually processed to form the new tobacco sheet of this invention within several minutes of their formation, but their unusually high stability permits storage before further processing, as may be required in commercial production of the eventual tobacco sheet.

To produce the tobacco sheet, the foams are cast into the desired sheet of widths and thicknesses dictated by the casting method as is known in the art. Conveniently, the foams are cast onto a moving belt, on which they are subjected to further treatment as required, e.g. drying to sheet material. The sheet dimensions can be varied widely as to overall width and thickness which is dictated by the final intended use. For example, if the sheet is intended for use as cigar wrapper the foam is cast at a thickness of about 0.016 to about 0.018 inch, wheras for cigar binder, the thickness is usually in the range 0.025 to 0.03 inches while for filler up to about 0.036 inches. The thickness of the foam as cast is controlled with a regulated doctor blade using art-recognized procedures.

Once cast, the foam is then dried to whatever moisture content is required by the intended and use. Normally, cigar tobacco wrapper has a moisture content of about 30–35%, whereas binder usually contains 16–20% and filler, 12–16%. The foam can be dried to the said moisture levels, or alternatively, the foam can be dried to a substantially dry sheet and then remoistened to any desired moisture content. The alternative drying and re-moistening of the sheet is preferred when the resulting sheet contains wet strength agents, e.g. cross-linking agents.

The cigar tobacco sheet, as produced, is characterized by a sheet density of from about 0.2 to about 0.45 g/cc, preferably 0.28 to 0.45 g/cc, and is used as cigar wrapper, binder and/or filler using conventional cigar-making apparatus.

DESCRIPTION OF PREFERRED EMBODIMENTS

The preferred new stable foams of the present invention are characterized by substantially uniform bubble size, predominantly less than 100 microns in diameter with less than 8% of the bubbles greater than 150 microns. Exemplary foams usually comprise at least 80% of bubbles of less than 100 microns with more than 30% less than 50 microns and less than 8% greater than 150 microns. The average bubble size of such foams is usually about 40 to about 65 microns. Especially preferred foams are those in which at least 90% of the bubbles are less than 100 microns with less than 2% in excess of 150 microns, with greater than 50% being less than 50 microns in diameter. The average bubble size of such foams is from about 45 to about 50 microns. Foams of densities of from about 0.92 to about 0.99 are preferred.

The tobacco to be employed in preparing the foam compositions is preferably of the low cost varieties, when whole leaf, or the usual fines or dust normally employed in making reconstituted sheet. This preference permits realization of the economic advantages of the present invention in that the final sheet tobacco products are of such highly-enhanced taste and aroma characteristics, which equal the same properties of high-cost shade tobacco leaf normally employed as wrapper for cigars.

To form the stable foams of this invention, a foam stabilizer must, of course, be present. At present, the preferred stabilizer is the stabilizer described in Monte, U.S. Pat. No. 3,613,693. As described therein, the stabilizer is ethylhydroxyethyl cellulose with an ethoxyl degree of substitution (D.S.) of 1.2 to 1.6 and a hydroxyethyl molar substitution (M.S.) of 0.5 to 1.2. The amounts of stabilizer incorporated into the foam can be varied considerably. Usually, less than about 1% of the stabilizer is found sufficient to attain the stability required, with amounts of 0.1 to 0.2% normally employed. Other foam stabilizers can be employed, the efficiency thereof being determinable by simply foaming a selected tobacco slurry and determining the nature of the foam produced to evaluate the stability thereof. Usually, the selected foam stabilizer will be considered suitable for the present foams when the foam bubbles assume a nearly perfectly cicular configuration. A minimum of testing by such routine procedures will permit the selection of other suitable foam stabilizers.

The preferred adhesives are those which are generally designated as high-gelation such as the methyl hydroxypropylcelluloses, which are especially suitable in the present new foams. Ethylhydroxyethyl cellulose, the preferred stabilizer, is also known for its high gelling properties.

The tobacco employed is predominantly that conventionally termed cigar tobacco in the art, being inclusive of air-cured, and fermented varieties as defined by the Cigar Research Council of the Cigar Manufacturer's Association.

Where 60% or more of the tobacco to be employed constitutes one or more of the cigar varieties, it is understood that the remainder of the tobacco portion of the composition may comprise any form of tobacco or tobacco substitute, the latter being, for example, cellulose, corn silk, oxidized cellulose or cellulose derivatives, etc. alone or in a mixture in any proportion.

The tobacco material including leaf, stem, waste, etc., is comminuted or ground to a state of relatively fine subdivision such that it will pass through a 100–120 mesh (U.S. Standard Sieve) screen. Preferably, the bulk of the material is of a dimension less than 140 mesh and a preponderance lies in the range of less than about 140 mesh and more than about 325 mesh.

The tobacco material is worked into a composition which comprises in general conventional reconstituted tobacco additives which may comprise up to 35% by weight of the whole, but normally are present only in 10–30% proportion. These additives include the naturally occurring gums such as the galactomannan gums, e.g. locust bean gum and guar gum, or their derivatives, particularly the ether derivatives as disclosed in copending and commonly assigned application Ser. No. 191,865 now U.S. Pat. No. 3,821,959 issued July 2, 1974 incorporated herein by reference; other plant gums such as the algins, carrageenins, laminarins, agar, starches, pectins, etc. cellulose as wool pulp, often of high (90% or more) alpha cellulose level or cellulose derivatives, particularly the ethers, especially methyl cellulose, hydroxyethyl cellulose, methyl hydroxethyl cellulose, ethylhydroxyethyl cellulose, etc.; cross-linking or wet strength agents such as glyoxal, dialdehyde starch and melamine and urea formaldehyde resins; humectants, such as glycerine, triethylene glycol and propylene glycol; various sugars; fungicides; colorants such as F.D.+C. Yellow No. 5, F.D.+C. Blue No. 1; and inorganic extenders such as diatomaceous earth, calcium carbonate, various clays and magnesium carbonate or sulfate. It is understood that one or another additives may function as both an adhesive and a wet strength resin, or as a colorant, etc.

It is important to the practice of this invention that the bubbles of the foam be carefully controlled within the limits described and for this purpose an ordinary inert gas is the most easily utilized vehicle, although other conventional methods of introducing voids to the tobacco dispersion such as blowing agents may be used. Among the preferred gases are air, nitrogen, carbon dioxide, froons and similar such gases. Where desired the gas may be cooled, or alternatively heated as by an electrical tape heater applied to the feed line. It may prove suitable to gasify, i.e. from at least the gross bubble structure, in a feed line containing only part of the dispersion ingredients prior to entry to the high shear zone.

The amount of gas introduced is a function of desired density under standard conditions, and ordinarily would simply be controlled on that basis, but it has also been found that drying rates are affected by gas content. Thus, the optimum drying rate appears to occur at a foam density of about 0.92 grams/cc with a 15% faster rate than identical unfoamed slurry at 1.03 grams/cc. Foaming beyond 0.92 grams/cc reverses the trend, as the insulating effect of the foam on heat transfer begins to predominate, yielding an effective limit to practical reductions in density, although greater amounts could be achieved.

It is a particular feature of the invention that cigar products of remarkably good taste can be produced from the reconstituted type sheets described. Reconstituted sheet materials, while of value in many smoking products as shred in cigarettes for example have never found acceptance in cigars because the wrapper and binder thereof contribute markedly to taste, more so than the weight per cent of the whole would suggest. Prior attempts at preparing cigar type reconstituted sheet have not met the critical test of taste acceptability for this market. Although organoleptic properties are necessarily subjective, a degree of standardization relevant to the test of the market place has been achieved by replicate taste testing by panels of experts in this art, utilizing the usual blind and doubleblind form of sample presentation.

In the testing reported herein, the taste panels were organized with 10 participants, each being trained and tested on ability to discriminate and describe sensory characteristics in smoking products and unmarked samples including conventionally produced cigars as well as the inventive materials were evaluated.

Taste panel results indicate that foamed reconstituted sheet material exhibits a noticeably adverse effect on taste at the 25% level as cigarette filler, whereas with the cigar wrapper/binder of this invention the taste is not only acceptable at a 100% substitution, but such substitution may proceed using ordinary cigar tobaccos (as opposed to high grade and hence expensive leaf). This effect is remarkable when panel results also show that taste properties of cigars are typically most affected by alteration in wrapper/binder.

While inhalation is not typical to cigar smoking, it is a potentially significant observation that cigars constructed with foamed wrapper and binder deliver upon combustion in standard tests 20–25% less tar than a natural leaf wrapper/conventional reconstituted binder cigar, at equivalent weight. Rate of burn for preferred compositions is increased as much as 20 percent, and this may be related to both this phenomenom and to the modified taste spectrum evidenced in panel testing.

Aesthetics of the sheet in respect of color, texture and general appearance are also much improved over that which is customarily seen in reconstituted sheet products. Thus, a regular grainy texture is apparent to the naked eye. In fact, this regularity of structure appears to interrelate with burning characteristics and hence taste. The texture also lightens the apparent coloration and increases opacity, thereby permitting at least a reduction in any additives otherwise employed for these purposes.

A particular feature of the aesthetic advantages of the sheet is the absence of staining in the tip region evidencing underlying adhesive which is a difficulty previously inherent in the use of reconstituted sheet for cigar wrapper.

By far the most dramatic advantageous aspect of the invention from the point of view of both the manufacturing process and the appearance of the ultimate product is the pliability or drapeability of the sheet at acceptable wet strength as compared with conventional reconstituted tabaccos. This is most clearly shown by the reject rates in manufacture of cigars, wherein wrapper and binder are stretched and drawn in a spiral manner to form the typical ovaloid shape. Commonly, tobacco leaf or reconstituted tobacco sheet as heretofore would result in a reject rate, which can be reduced by half or more using the sheet of this invention.

The cigar sheet and cigars themselves may be prepared in accordance with any conventional techniques. The preferred smoking articles are cigars wherein at least the wrapper is composed entirely of the foamed tobacco material of this invention. The binder is also desirably so constructed, and the whole of the cigar may be fabricated from the inventive sheet if so desired. It is understood that reference to cigars and cigar sheet is intended to be inclusive of both large and small cigars and cigarillos in which integral sheet is employed.

The cigar sheets of this invention resemble natural sponge or coral under magnification, and contain numerous voids, spaces, air traps, etc. of various geometric shapes separated by thin often continuous feathery or leaf-like walls. The appearance is similar to the structure of natural animal or plant matter which may in part explain the extraordinary success of its substitution for high quality natural leaf.

Normal natural cigar tobacco leaf is essentially nonporous and exhibits a density of about 0.59 g/cc. Reconstituted cigar sheet typically is prepared to a density of 0.5 g/cc and a thickness of 0.0027 inch. The foamed sheets of this invention ordinarily are manufactured to a thickness of at least 0.003 inch for wrapper and at least 0.007 for binder, at a sheet weight of about 3 g/ft.$^2$ for wrapper and about 5 g/ft.$^2$ for binder preferably, the cigar tobacco sheets are essentially non-porous.

As set forth in the following Examples representing the preferred embodiments of the invention all parts are by weight unless otherwise designated and the terms and tests employed are as defined in the following passage.

TEST PROCEDURES

Foam Density: a sample of the foam is transferred to fill a cup of calibrated volume, the weight of foam determined and then divided by the cup volume to give foam density.

Percent Equilibrated Sheet Moisture: values for percent moisture are obtained using a drying temperature of 95° C and a drying time of two hours. The percent moisture is calculated as follows:

$$\% \text{ Moisture} = \frac{\text{Wet Weight} - \text{Dry Weight}}{\text{Wet Weight}} \times 100$$

Sheet Weight: Unless otherwise specified, the term sheet weight refers to the dry weight of sheet per unit of area. The drying conditions used in the determination of the bone-dry weight of a representative sheet area are the same as those used in the determination of percent moisture given above. When less than one square foot of sheet is dried, the bone-dry weight obtained is converted to the weight of one square foot.

Sheet Porosity: The rate of air transmission through a sheet sample is measured with a Gurley Densometer (Model No. 4110, FIG. 12). Porosity is expressed as the time in seconds, required for 300 ml. of air to pass through a standard sheet area. The smaller the number of seconds, the more porous is the sheet sample. If the time is greater than 5 minutes, the sheet is considered non-porous.

Sheet Thickness: A Federal gauge (Model No. 573-1-Y-7692, FIG. 13) is used to measure the sheet thickness. The procedure involves insertion of the sheet under the anvil of the Federal gauge and reading the thickness in mils (thousandths of an inch).

Sheet Density: The sheet density (weight/volume) is caculated from a formula using dry sheet weight in gm/ft$^2$ and the equilibrated (68% RH, 72° F) Federal gauge sheet thickness in mils. Sheet density is expressed in gm/cc. The sheet density is calculated using a formulation derived as follows:

$$\text{Sheet Density (grams/cc)} = \frac{\text{Sheet Weight (gm/ft}^2)}{\text{Sheet Volume (cc/ft}^2)}$$

$$\frac{\text{Sheet Weight (gm/ft}^2)}{\text{Sheet Thickness (ft)} \times \text{Sheet Area (ft}^2) \times 28{,}317\ (\text{cc/ft}^3) \times \frac{1}{\text{ft}^2}}$$

$$\frac{\text{Sheet Weight (gm/ft}^2)}{\text{Sheet Thickness (mils)} \times 10^{-3}\ (\text{in/mil}) \times \frac{1}{12}\ \frac{\text{ft}}{\text{in}} \times 1\ \text{ft}^2 \times 28{,}317\ (\text{cc/ft}^3) \times 1/f}$$

Viscosity: Viscosities are measured on a Brookfield RVF viscometer, spindle No. 4 at 20 rpm, at temperatures of 16°–25° C.

Bubble Size Determination: The foam was mounted on a microscope slide and under the microscope, sections of the foam were randomly photographed. Five photographed specimens of each foam were then enlarged and inspected, the bubbles measured, and the bubble size distribution determined by counting.

Tensile Strength Determination: Sheets are measured for tensile strength on a Standard Scott Tester (Model No. IP-2). Test samples are cut with a razor to 1 inch × 4 inch dimensions using a 1 inch × 4 inch metal template. Samples are cut from the sheet in both the length (longitudinal) and width (Transverse) of the sheet. The tensile strength refers to the load per inch of sample required to break the sample strip and is recorded in gram/inch.

EXAMPLE I

A baseweb composition containing non-tobacco ingredients is prepared. 845 Pounds of 3.39% aqueous dispersion of highly-refined sulfite pulp is charged into a Cowles mixer-equipped vacuum tank and 160 pounds of water added. 17.2 Pounds of guar gum prewetted with 30 pounds isopropyl alcohol is added with agitation to the pulp and stirring continued under a vacuum of 28 inches for 45 minutes. Then 1.5 pounds of 85% $H_3Po_4$ diluted with 10 pounds of water is added to the dispersion followed by 6 pounds of 80% solution of the trimethyl ether of trimethylolmelamine prediluted with 20 pounds of water. Mixing under vacuum is continued for 30 minutes. A dispersion of 3.7 pounds of diatomaceous earth, 13.5 pounds triethylene glycol and 90 pounds of $H_2O$ is then added and allowed to mix for an additional 15 minutes under vacuum.

Separately, 10.2 pounds of methylhydroxy-propylcellulose (2% solution viscosity = 15,00 cps, gelation temperature of 90° C.), 10.2 pounds of methylhydroxypropyl cellulose (2% solution viscosity = 4000 cps, gelation temperature of 90° C) and 0.5 pounds of ethylhydroxyethyl cellulose (ethoxyl D.S. of 1.2 hydroxyethyl M.S. of 0.5, 2% solution viscosity = 15,000 cps) are prewetted with 200 pounds of hot water (above 90° C) and the dispersion sucked into the vacuum tank while maintaining the vacuum and continuing agitation for an additional 15 minutes.

Sequentially, 300 pounds of ice and 200 pounds of water are added while washing down the vessel sides making a total of 1100 pounds of water used in preparing the base web. The total completed baseweb weighs 2175 pounds, and is deaerated for 45 minutes at temperatures below 65° F. The final dispersion has 3.88% solids and pH=3.85.

In a separate mixing vessel, equipped with a paddle agitator, 194 pounds of Wisconsin leaf dust (more than 99% passes through a 100 mesh U.S. Standard Sieve) 6 pounds of Turkish whole leaf dust (same sieve size), 8 pounds of Ca $Co_3$, 8 pounds of diatomaceous earth, 0.47 pounds of fungicide, and 1.7 pounds of 10% solution of FD & C yellow No. 5 are dispersed in 1025 pounds of $H_2O$ and 100 pounds of ice with mixing. 9 Pounds of 28% solution NaoH (aq) are added to adjust to pH8.1. The final dispersion has a solids content of 15.8%.

In a continuous mixing system controlled with variable speed pumps, the baseweb and tobacco streams are continuously fed into a mixing tank at a ratio of 2.04 pounds of baseweb to 1.00 pounds of tobacco dispersion. The vessel size is such that there is an average residence time of mixing of 15 minutes prior to charging to a high shear rotor/stator Oakes mixer in which the clearance between the stator and rotor pins is 0.02 inches and the peripheral speed is 140 ft./sec. The throughput of slurry is 15 pounds/min. with nitrogen injection into the head of the mixer at a rate such that the foamed slurry emerging has a foam density of 0.98 g/cc.

Microscopic analysis of the foam shows that 53.5% of the bubbles are less than 50 microns in diameter, 98.6% are less than 100 microns and 0% are greater than 150 microns, with an average dimension of 50 microns.

The foamed slurry is cast on a stainless belt moving at 65 ft/min. at a wet film thickness of 0.018 inches and dried by impinging steam on the belt underside in conjunction with sweeping, dry, hot air over the surface of the foam. The dried foam sheet is coated with a 4% solution of ethylcellulose in 91% isopropanol at a level of 1.5 g. of solution/sq. ft. of sheet and the solvent volatilized. The sheet is then rehumidified to 32% moisture, doctor-removed from the belt. The sheet weighed 3.0 g/sq. ft. (dry weight), had a thickness of 0.0038 in., and wet transverse tensile strength of 150 g/in. of width and rolled.

The roll of tobacco sheet is slit to two inch widths which approximate the width of the particular cigar machine die on which cigars are prepared. The two inch width roll is loaded onto an automatic wrapper feed attachment to the cigar-making machine and is fed automatically to wrap cigars.

Cigars prepared with the wrapper so produced, using conventional binder (unfoamed) and conventional cigar filler blend when compared to otherwise identical cigars using natural Connecticut shade tobacco as wrappers were judged by expert taste panels using statistical procedures to determine the significance of the results. The results showed that the compared cigars were identical in all taste and aroma characteristics including cold aroma, cold taste, combustion aroma and taste, and aftertaste.

Examination of the reconstituted wrapper cigars for physical characteristics showed excellent conformance to the cigar shape without significant wrinkling, a lack of visible staining of the cigar heads by the headpaste and a color comparable to natural Connecticut Shade wrapper. The texture and appearance of the wrapper compared favorably with the Connecticut Shade wrapper.

The smoke of the foamed reconstituted wrapper cigars was compared to that of the natural wrapper cigar using standard analytical procedures with the following results:

| | Carbon Monoxide (% gas phase) | Cigar Wt. (g.) | Pressure Drop (in $H_2O$) | Wet Tars per Cigar | Wet Tars per g. Tobacco consumed | No. of puffs per Cigar |
|---|---|---|---|---|---|---|
| Natural Wrapper | 15.5 | 3.67 | 2.1 | 16.9 | 72 | 29 |
| Foamed Reconstituted Wrapper | 13.2 | 3.86 | 2.2 | 13.5 | 52 | 24 |
| % Reduction | 15 | — | — | 20 | 27 | 17 |

A comparison of unfoamed reconstituted tobacco sheet wrapper cigars with natural wrapper cigars normally shows an increase in wet tars of about 25% and increases in carbon monoxide of about 60%.

During cigar manufacture with the foamed reconstituted tobacco wrapper over prolonged periods of observation and with various sizes of cigars, it was noted that the total percentage of reject cigars due to all causes including unsatisfactory head work, poor or broken tucks, bad bunches, misrolls, and miscellaneous defects was reduced by 50% of the normal reject rate for natural tobacco wrapped cigars. The reduction in rejections due to wrapper performance only was substantially higher.

EXAMPLE 2

A cigar binder sheet is prepared using the procedure of Example 1. The combined baseweb and tobacco dispersions is foamed to a foam density of 0.92 g/cc. by using a peripheral speed of 30 ft/sec. in the rotor-stator mixer of which the rotor-stator pin clearance is adjusted to 0.1 inches.

The foam is cast onto the steel belt at a flow rate of 22 lbs. per minute to a thickness of 0.032 in. The bubble size distribution of the foam showed 43.2% of the bubbles were less than 50 microns, 88.8% were less than 100 microns and 4.8% were greater than 150 microns, with an average of 65 microns. The resulting dried sheet weighed 5.1 g/sq. ft. with a thickness of 0.007 in.

The binder roll thus produced, at 18% moisture content, was slit to a roll width of 3 5/8 in. for use as cigar binder. Cigars produced with this binder and the wrapper of Example 1 generally showed slightly greater reduction in undesirable taste and aroma characteristics on evaluation by expert taste panels.

EXAMPLE 3

A reconstituted cigar wrapper was prepared in accordance with the procedure of Example 1 but utilizing the following ingredients:

| | Percent Solids |
|---|---|
| Sulfite pulp (highly refined) | 9.734 |
| Guar gum | 5.548 |
| $H_3PO_4$ | 0.442 |
| Trimethylolmelamine (trimethylether) | 1.634 |
| Celite (diatamaceous earth) | 3.846 |
| Triethylene glycol | 4.595 |
| Methyl hydroxypropyl cellulose (2% solution viscosity = 15,000 cps, gelation temperature 90° C) | 3.301 |
| Methyl hydroxypropyl cellulose (2% solution viscosity = 4,000 cps, gelation temperature 90° C) | 3.301 |
| ethyl hydroxyethyl cellulose (ethoxyl D.S. of 1.2 hydroxyethyl, M.S. of 0.5, 2% solution solution viscosity = 15,000 cps) | 0.136 |
| Tobacco (Wisconsin leaf dust) | 61.215 |
| $CaCO_3$ | 2.652 |
| NaOH | 0.551 |
| Thiabendazole (fungicide) | 0.294 |
| Egg albumen (water-soluble) | 2.836 |

The baseweb composition had a solids content of 4.03%, viscosity 29,500 cps., pH= 3.84 and a temperature of 15° C.

The tobacco dispersion had a solids content of 16.84% and pH= 7.85.

When the baseweb and tobacco dispersions were combined, the resulting slurry had a solids content of 7.95%, viscosity of 12,750 cps., pH = 7.95 and a temperature of 17° C.

The slurry after foaming showed essentially the same bubble size and distribution as that of the Example 1 foam.

The foam was then cast and processed to a sheet of the following characteristics:

| | |
|---|---|
| Weight | 3.01 - 3.08 g/ft² |

-continued

| | | | |
|---|---|---|---|
| Moisture | 33 - 36.2% | | |
| Transverse Wet Strength | 188 g./in. of width | | |
| Color (Gardner | Rd | +a | +b |
| Colorimeter) | 13.7 | 5.6 | 18.0 |

Cigars prepared with the sheet as wrapper showed excellent taste and aroma characteristics and compared favorably with otherwise identical cigars with natural leaf wrapper when evaluated by taste panels.

EXAMPLE 4

A reconstituted cigar binder was prepared in accordance with the procedure of Example 2, but utilizing the following ingredients:

| | Percent Solids |
|---|---|
| Sulfite pulp (highly refined) | 11.453 |
| Locust bean gum | 7.514 |
| Carboxymethyl cellulose (good grade) | 3.756 |
| Celite (diatomaceous earth) | 2.291 |
| Triethylene glycol | 5.726 |
| Methylhydroxypropyl cellulose (2% solution viscosity = 50 cps) | 2.624 |
| Ethylhydroxyethyl cellulose (ethoxyl D.S. of 1.2 hydroxyethyl, M.S. of 0.5, 2% solution viscosity = 15,000 cps) | 0.198 |
| Glyoxal | 3.438 |
| Tobacco (Wisconsin leaf dust) | 63.00 |

The beltweb composition had a solids content of 7.67%; viscosity = 40,000 cps (22° C) and pH = 6.12.

The tobacco suspension had a solids content of 16.6%, viscosity = 600 cps at 16° C. and pH = 6.58.

The combined slurry of beltweb and tobacco suspension had a solids content of 11.35%, viscosity = 17,000 cps. at 20° C. and pH = 6.52. The beltweb and tobacco suspensions were combined in a ratio of 1.28 to provide 65% tobacco in the dry sheet eventually produced.

The foamed slurry showed essentially the same bubble size and distribution as the Example 2 foam. The foam density was 0.921 g/cc., the cast foam sheet was 32 mils and the drying belt was maintained at 45 ft/min.

The resulting binder sheet had the following properties:

| | | | |
|---|---|---|---|
| Weight | 5.14 - 5.18 g./ft$^2$ | | |
| Moisture | 18 - 20.5% | | |
| Strength | | | |
| Length (dry) | 1200 g/in. | | |
| Length (wet) | 790 g/in. | | |
| Transverse (dry) | 535 g/in. | | |
| Transverse (wet) | 246 g/in. | | |
| Color (Gardner Colorimeter) | | | |
| Rd | +a | +b | |
| 14.3 | 5.9 | 17.3 | |

The use of the binder in producing cigars wrapped with the wrapper of Example 3 gave substantially identical results as the binder of Example 2.

EXAMPLE 5

Similarly to the procedure of Example 1, foam sheet may be prepared utilizing a dispersion containing only tobacco particles in water together with less than 1% of ethylhydroxyethyl cellulose as a foam stabilizer.

COMPARATIVE EXAMPLE

For comparison, foams were prepared in accordance with the procedures described in the aforesaid Monte and Moshy, et al. patents, exactly duplicating the procedures of Example 1 of each of said patents. The foams were then comparatively analyzed with those produced in accordance with the present invention.

The foamed compositions of the Monte patent were more stable than those of the Moshy, et al. patent. Microscopic analysis of the respective foams as to bubble size and distribution gave the following results:

| | Below 50 μ | 51-100 μ | 101-150 μ | above 150 μ | >300 μ | Average |
|---|---|---|---|---|---|---|
| Monte (a) | 15.87 | 36.68 | 23.02 | 16.6 | 4.76 | 178 |
| Moshy, et al. (b) | 5.88 | 14.71 | 26.47 | 35.29 | 17.65 | 199 |

a. The foams produced in accordance with Monte Example 1 (density = 0.535) underwent some changes during examination in that larger bubbles did break.

b. The Moshy, et al. foams (density = 0.065) not being as stable as Monte foams, were only determined with considerable difficulty. When tobacco dust was added to the Moshy, et al. foam, the foam tended to break up which did not permit ample time for meaningful analysis in which case the foam was inspected without tobacco dust present.

The bubbles of the Monte foam were well formed circular bubbles but not very uniform in size as is obvious from the size distribution data. The Moshy et al. foams did not exhibit well-defined bubbles but highly varied shapes with no regular geometric patterns noticed.

The range of bubble size (minimum to maximum detected) for Monte foams was 20–516 μ while for Moshy et al. foams, 40–546 μ.

Tobacco sheets prepared with the Monte foams do not have the fine texture and appearance, excellent taste and aroma characteristics, or suitability for wrapper for cigars which the new tobacco sheets of the present invention exhibit. Monte foam sheets show substantial numbers of holes which, though fine, are noticeable on simple visual inspection.

What is claimed is:

1. A stable foam comprising a reconstituted tobacco composition incorporating finely divided cigar tobacco and uniformly dispersed throughout said composition, a multiplicity of fine bubbles, at least 80% of the bubbles being less than about 100 microns in dimension, said bubbles acting to uniformly reduce the density of said composition.

2. Composition as in claim 1 wherein at least 90% of the bubbles are less than 100 microns and less than 2% are greater than 150 microns.

3. Composition as in claim 2 wherein at least 50% of said bubbles are less than 50 microns.

4. The composition of claim 1, wherein the foam structure is stabilized by the presence of up to about 1% of ethylhydroxyethyl cellulose.

5. Reconstituted cigar tobacco sheet composed predominantly of cigar tobacco particles having a sheet density of from about 0.2 up to about 0.45 g/cc, prepared by drying a stable foam containing uniformly dispersed bubbles wherein at least 80% of the bubbles are less than 100 microns.

6. The tobacco sheet of claim 5, wherein the internal structure of said sheet resembeles natural sponge or coral.

7. The sheet of claim 5, wherein said sheet is essentially non-porous and is prepared by drying a stable foam containing uniformly dispersed bubbles wherein at least 90% of the bubbles are less than 100 microns and less than 2% are greater than 150 microns.

8. A cigar comprising a wrapper constituted by the sheet of claim 7.

9. A cigar wrapper sheet composed predominantly of cigar tobacco particles having a sheet density of from about 0.2 to about 0.45 g/cc, a thickness of about 0.003 to about 0.007 inches, said sheet being essentially non-porous, and being prepared by drying a stable foam containing uniformly dispersed bubbles wherein at least 50% of the bubbles are less than 50 microns.

10. The cigar wrapper sheet of claim 9 wherein the average bubble size is from about 45 to about 50 microns.

* * * * *